US005953566A

United States Patent [19]

Fujiwara et al.

[11] Patent Number: 5,953,566

[45] Date of Patent: Sep. 14, 1999

[54] COLOR IMAGE FORMING METHOD AND APPARATUS PROVIDING FOR EFFICIENT TONER TRANSFER BASED ON TONER ZETA POTENTIALS

[75] Inventors: Toshimitsu Fujiwara, Osaka; Shuji Iino, Otsu; Masaharu Kanazawa, Suita; Seishi Ojima; Hidetoshi Miyamoto, both of Takatsuki, all of Japan

[73] Assignee: Minolta Co., Ltd., Japan

[21] Appl. No.: 09/063,039

[22] Filed: Apr. 21, 1998

[30] Foreign Application Priority Data

Apr. 22, 1997 [JP] Japan ..... 9-104276

[51] Int. Cl.[6] ..... G03G 9/12; G03G 15/01

[52] U.S. Cl. ..... 399/223; 399/298; 430/42; 430/47

[58] Field of Search ..... 399/223, 298, 399/231, 299, 302; 430/42, 47

[56] References Cited

U.S. PATENT DOCUMENTS 4,880,720 11/1989 Drappel et al. .

4,935,788 6/1990 Fantuzzo et al. ..... 399/299

4,946,753 8/1990 Elmasry et al. ..... 430/45

FOREIGN PATENT DOCUMENTS 57-119378 7/1982 Japan .

*Primary Examiner*—Joan Pendegrass

*Attorney, Agent, or Firm*—McDermott, Will & Emery

[57] ABSTRACT

A color image forming method and apparatus of the electrophotographic type with a plurality of liquid developing devices. In a plurality of liquid developing devices accommodating liquid developer comprising colored microparticles dispersed in an electrically insulated fluid medium are used to form toner images of different colors, which are electrostatically transferred and overlaid one over another on a transfer medium to produce an overlaid toner image. The color image forming method and apparatus providing excellent overlay transfer characteristics for toner images transferred to a transfer medium.

20 Claims, 2 Drawing Sheets

COLOR IMAGE FORMING METHOD AND APPARATUS PROVIDING FOR EFFICIENT TONER TRANSFER BASED ON TONER ZETA POTENTIALS

This application is based on application No.9-104276 filed in Japan, the contents of which are hereby incorporated by reference.

BACKGROUND OF THE INVENTION

1. Field of the Invention

The present invention relates to an image forming method and apparatus, or a color image forming method and apparatus.

More specifically, the present invention relates to a color image forming method and apparatus of the electrophotographic type.

Still more specifically, the present invention relates to a color image forming method and apparatus of the electrophotographic type, wherein a plurality of liquid developing devices accommodating liquid developer comprising colored microparticles dispersed in an electrically insulated fluid medium are used to form toner images of different colors, which are electrostatically transferred and overlaid one over another on a transfer medium such as a recording sheet or the like or an intermediate transfer member to produce an overlaid toner image.

2. Description of the Related Art

In image formation via electrophotographic methods, typically an electrostatic latent image is formed on a latent image carrying member such as a photosensitive member or the like via optical image exposure corresponding to a document image or image data, and this electrostatic latent image is developed as a visible toner image, which is subsequently transferred to and fixed on a recording member to produce a final target image.

Developing methods can be broadly divided into dry type developing methods and wet type developing methods; the developers currently most widely used as liquid developers in wet type developing are liquid developers formed of charge controller, dispersion stabilizer, and colored microparticles (toner) comprising mainly pigment and binder resin dispersed in an electrically insulated dispersion medium (carrier fluid). The toner charge is attained by ion absorption of the charge controller, and the charged toner is supplied for developing by the principle of electrophoresis.

The toner used in wet type developing can be finer than toner used in dry type developing because there is no concern of airborne dispersion into the atmosphere, and it is possible to use toner having a mean particle size in the submicron range. The use of such fine toner microparticles is advantageous in producing high resolution images and ease of fixing the toner image.

When forming color images using such liquid developers, toner images of various colors, for example, cyan, yellow, magenta, and black, are respectively formed on an electrostatic latent image carrying member for each color, and the toner image of each color is electrostatically transferred so as to sequentially superimpose said color images one on another on a transfer member such as a recording member or intermediate transfer member to produce a color image via the overlaying of said color toners. When a color image has been formed on an intermediate transfer member, the color image is subsequently thermally transferred onto a recording member to produce the ultimate color image. Furthermore, the toner image of each color may be sequentially formed on a single electrostatic latent image carrying member, then sequentially transferred and overlaid on a transfer member via electrostatic transfer to produce the ultimate color image.

When performing such multilayer transfers, however, the electric field used for transfer becomes difficult to maintain as the toner layers are superimposed on the transfer medium due to the high resistance of the toner, thereby adversely affecting transfer efficiency. The toner charge is particularly high in the case of small size toner particles used in liquid developers, which necessitates the use of a high electric field to achieve electrostatic transfer and results in even greater difficulty in transferring multilayer images due to the even greater difficulty of maintaining the electric field to overlay and adhere sequential toner layers on a transfer medium in multilayer transfers.

An object of the present invention is to provide a color image forming method and apparatus having excellent multilayer transfer characteristics for toner images transferred to a transfer medium in a color image forming method and device of the electrophotographic type using a plurality of liquid developing devices accommodating liquid developers comprising colored particles dispersed in an electrically insulated fluid medium to form toner images of different colors, and sequentially overlay said toner images on a transfer medium via electrostatic transfer to produce a multilayer toner image.

SUMMARY OF THE INVENTION

The present inventors have conducted in-depth research to attain the aforesaid objects, the results of said research being described below.

When an external electric field is applied to a system comprising particles possessing a surface charge dispersed in a fluid, these particles move under the influence of the electric field in a so-called electrophoresis phenomenon. When observing the flow of the fluid from the particles as the particles move within the fluid, the more distance fluid appears to move more rapidly, while the fluid appears unmoving in the vicinity of the particle surface. The interface between the apparently unmoving fluid and the fluid farther from the particle is a sliding surface, and particles were observed to simultaneously move with a certain amount of fluid in tow. The electric potential in this sliding surface is called the zeta potential.

When using a liquid developer, the toner image is typically transferred to an intermediate transfer member or recording member before the carrier has completely evaporated after development. In this instance, the toner particles migrate within the carrier fluid and move to the intermediate transfer member or recording member. The phenomenon of the migration of the particles in the fluid is mostly explained by the zeta potential. As one example, consider the Huckel equation below (Phys. Z., vol. 25 (1924), p. 204).

$$v=(2/3)\cdot(\epsilon r\cdot\eta 0/\eta)\cdot\zeta$$

Where v represents the particle migration speed, $\epsilon r$ and $\epsilon 0$ respectively represent the relative permittivity of the fluid and vacuum, $\eta$ represents the viscosity, and $\zeta$ represents the zeta potential.

The transfer speed in liquid developing using electrophoresis therefore is dependent on the zeta potential ($\zeta$). Accordingly, if the absolute value of the zeta potential of the developer is adjusted so as to be higher in the post-transfer stage, the aforesaid reduction in transfer efficiency can be suppressed without increasing the transfer voltage because the electric field used for transfer works effectively.

Based on these findings, the present invention provides, a color image forming method of the electrophotographic type using a plurality of liquid developing devices accommodating liquid developers comprising colored particles (toner) dispersed in an electrically insulated fluid medium (carrier) to form toner images of different colors and sequentially overlay said toner images on a transfer medium via electrostatic transfer to produce a multilayer toner image, wherein the absolute values of the zeta potential of liquid developers accommodated in developing devices are set sequentially higher from a liquid developing device used to produce a first toner image transferred to a transfer medium to a liquid developing device used to produce a final toner image transferred to said transfer medium.

The present invention further provides a color image forming apparatus of the electrophotographic type using a plurality of liquid developing devices accommodating liquid developers comprising colored particles (toner) dispersed in an electrically insulated fluid medium (carrier) to form toner images of different colors and sequentially overlay said toner images on a transfer medium via electrostatic transfer to produce a multilayer toner image, wherein the absolute values of the zeta potential of liquid developers accommodated in developing devices are set sequentially higher from a liquid developing device used to produce a first toner image transferred to a transfer medium to a liquid developing device used to produce a final toner image transferred to said transfer medium.

These and other objects, advantages and features of the invention will become apparent from the following description thereof taken in conjunction with the accompanying drawing which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
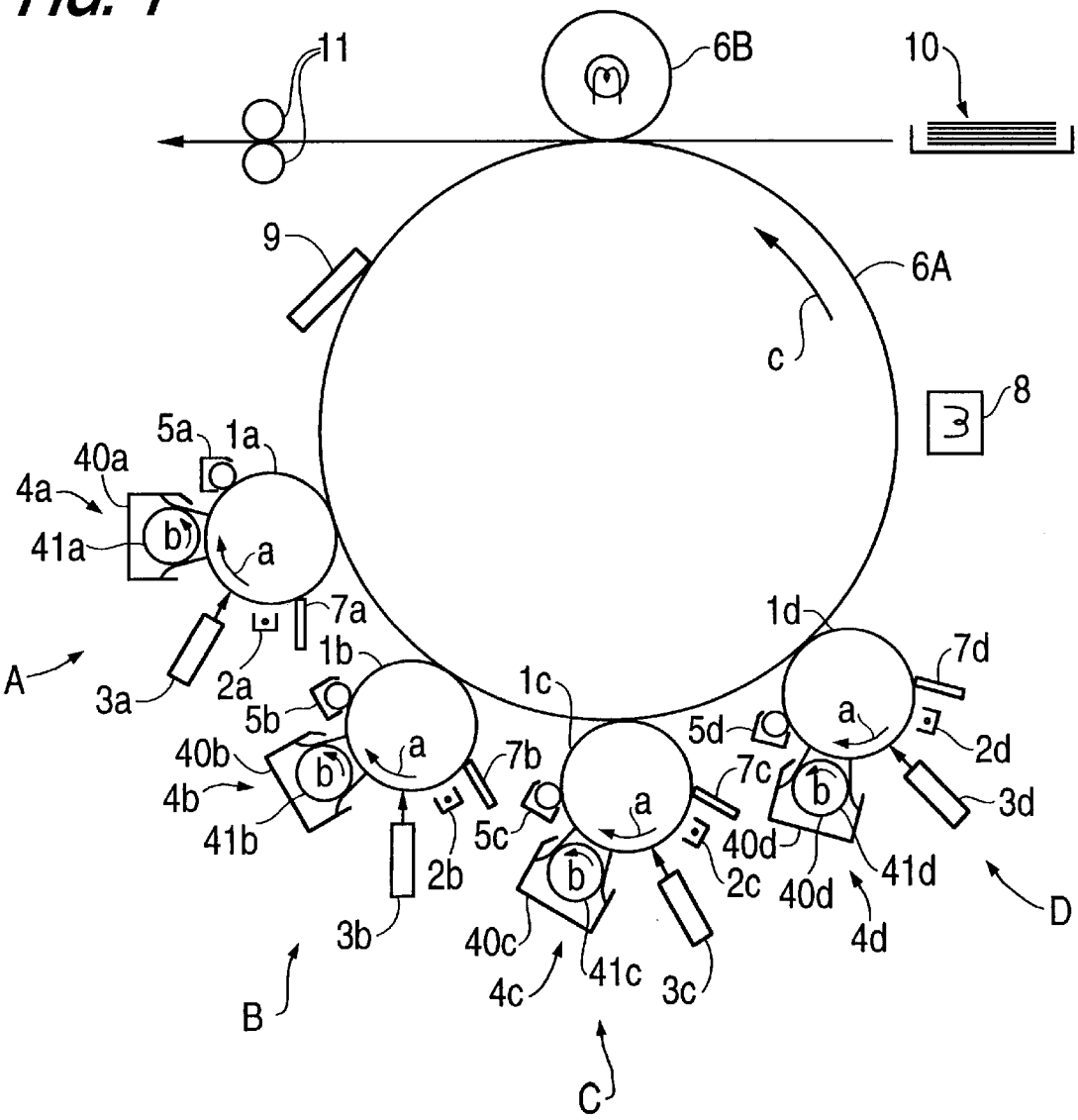
FIG. 1 briefly shows the an example of the internal construction of an image forming apparatus.

A preferred embodiment of the color image forming method of the present invention is a color image forming method of the electrophotographic type using a plurality of liquid developing devices accommodating liquid developers comprising a toner dispersed in an electrically insulated carrier fluid to form toner images of different colors and sequentially overlay said toner images on a transfer medium via electrostatic transfer to produce a multilayer toner image, wherein the absolute values of the zeta potential of liquid developers accommodated in developing devices are set sequentially higher from a liquid developing device used to produce a first toner image transferred to a transfer medium to a liquid developing device used to produce a final toner image transferred to said transfer medium.

When the aforesaid transfer medium is an intermediate transfer member, the obtained multilayer toner image may be ultimately transferred to and fixed on a recording member.

A preferred embodiment of the color image forming apparatus of the present invention is a color image forming apparatus of the electrophotographic type using a plurality of liquid developing devices accommodating liquid developers comprising toner dispersed in an electrically insulated carrier fluid to form toner images of mutually different colors and sequentially overlay said toner images on a transfer medium via electrostatic transfer to produce a multilayer toner image utilizing the aforesaid method, wherein the absolute values of the zeta potential of liquid developers accommodated in developing devices are set sequentially higher from a liquid developing device used to produce a first toner image transferred to a transfer medium to a liquid developing device used to produce a final toner image transferred to said transfer medium.

In this image forming apparatus, when the transfer medium is an intermediate transfer member, the multilayer toner image formed on said intermediate transfer member may be transferred to and fixed on a recording member by a transfer device and fixing device.

When the toner particles migrate in the carrier liquid, the relationship between the zeta potential and the amount of charge (Q/M) per unit weight of the particle is expressed by the equation below. The particles are considered spherical, with a specific gravity of 1. The value r is the diameter of the spherical particle.

$$\zeta = Q/(4\pi\cdot\epsilon r\cdot\epsilon 0\cdot r) = (Q/M)\cdot r^2/(3\cdot\epsilon r\cdot\epsilon 0)$$

Since the zeta potential and the amount of charge per unit weight are correlated values, the zeta potential can be changed by the amount of charge per unit weight of toner particles in the color image forming method and apparatus of the preferred embodiments of the present invention. Furthermore, as can be understood from the equation above, the zeta potential can be independently changed by means of other parameters such as toner particle size, specific inductive capacity $\epsilon r$ of the carrier fluid and the like. Specifically, adjustment of the zeta potential can be accomplished by suitably changing the type of charge controller, the amount of added charge controller, the type or characteristics (i.e., acid value, polar resin blend and the like) of the binder resin used to form the toner, shape of the toner particles (i.e., surface area, particle size and the like), type of carrier fluid and the like.

According to the color image forming method and apparatus of the preferred embodiments of the present invention, the electric field used for image transfer can be effectively utilized by using a liquid developer having a zeta potential of a large absolute value in the post-transfer stage when transferring a plurality of toner images to be sequentially overlaid on an intermediate transfer member or a recording member, thereby suppressing a reduction in transfer efficiency typically caused by accumulated toner without an exceptionally large increase in the electric field used for transfer.

The liquid developer of various colors used in the color image forming method and apparatus of the preferred embodiments of the present invention may be manufactured, for example, as described below.

Toner particles may be manufactured by well-known methods giving consideration to the type of binder resin, shape such as desired size and the like, and added materials including colorant such as pigments and dyes, charge controllers, waxes and the like. Examples of usable toner manufacturing methods include dry-type manufacturing methods including dry-type pulverization using a jet mill, and wet-type manufacturing methods such as emulsion-dispersion-granulation, suspension polymerization, emulsion polymerization, nonaqueous dispersion polymerization, seed polymerization, wet-type pulverization using a media mill, and wet-type grinding methods and the like.

Toner particles produced by the aforesaid methods are dispersed in an electrically insulated carrier fluid using a high shear force dispersion device, homogenizer, ultrasound dispersion device or the like. When necessary, toner particles may be dispersed by the aforesaid methods with the additives such as charge controller, dispersion agent, fixing enhancer and the like already added.

The density of the toner in the carrier fluid is desirably 0.5~50 percent-by-weight (hereinafter abbreviated to "wt %"), and more desirably 2~10 wt %, from the perspectives of developing speed and image fog and the like. This density is the density during the developing process, and the density need not be maintained during storage, replenishment, transport and the like.

Well-known pigments and dyes such as carbon black, phthalocyanine and the like may be used as colorants. The amount of added colorant relative to resin is desirably about 5~20 parts-by-weight (hereinafter abbreviated to "pbw") relative to 100 pbw resin. The resin itself may be colored.

The binder resin used to form the toner particles are not specifically limited insofar as such resin has thermoplasticity and is not actually soluble in the carrier fluid. Examples of useful binder resins include, thermoplastic saturated polyester resin, styrene-acrylic copolymer resin, styrene-acrylic transformed polyester resin, polyolefin copolymer resin (particularly ethylene copolymer), epoxy resin, rosin-transformed phenol, rosin-transformed maleic acid resin and the like used individually or in combination. Resins such as paraffin wax, polyolefin wax and the like may be blended in a range of less than 20 wt % as a separation agent.

Polyester resin is particularly desirable inasmuch as such resin not only allows changing of physical characteristics such as thermal characteristics over a broad range, it also produces beautiful color due to its excellent light transmittance when used in color images, the resin layer is resilient after fixing due to its excellent spreadability and elasticity, and the resin possesses excellent adhesion characteristics relative to recording media such as paper and the like.

Specifically, polyester resin is a resin formed by condensation polymerization of polyester resin, polyvalent alcohol, and polyvalent basic acid (polyvalent carboxylic acid).

Examples of polyvalent alcohols include but are not limited to ethylene glycol, diethylene glycol, triethylene glycol, propylene glycols such as 1,2-propylene glycol and the like, dipropylene glycol, butane diols such as 1,4-butane diol and the like, alkylene glycols (aliphatic glycol) such as hexane diols such as 1,6-hexane diol and the like and alkylene oxides thereof, phenol glycols such as bisphenols such as bisphenol-A, bisphenol containing hydrogen and the like and alkylene oxides thereof, alicyclic and aromatic diols such as monocyclic and polycyclic diols, and triols such as glycerin, trimethylol propane and the like. These materials may be used individually or in combinations of two or more.

Addition of 2~3 molar alkylene oxides such as neopentyl glycol and bisphenol-A is particularly desirable due to low cost and suitability for toner binder resin in liquid developer due to the solubility and stability of the raw polyester resin. Examples of useful alkylene oxides include ethylene oxide, propylene oxide and the like.

Examples of useful polyvalent basic acids (polyvalent carboxylic acid) include but are not limited to malonic acid, succinic acid, adipic acid, azelaic acid, sebacic acid, fumaric acid, maleic acid, itaconic acid, phthalic acid and transformed acids thereof (e.g., hexahydrophthalic anhydride), isophthalic acid, saturated and unsaturated bivalent basic acids such as terephthalic acid, trimellitic acid, pyromellitic acid, saturated polyvalent basic acids having three or more functional groups such as methyl nadic acid and the like, and acid anhydrides and low molecular alkyl esters thereof. These materials may be used individually or in combinations of two or more.

Isophthalic acid and terephthalic acid are particularly desirable due to their low cost and suitability for toner binder resin in liquid developer due to the solubility and stability of the raw polyester resin.

Well-known and normally used polymerization methods may be used. Polymerization will differ depending on the raw monomers used, but will generally be performed as described below.

A polyvalent alcohol and polyvalent basic acid are condensed in a partial condenser or the like while being mixed in an atmosphere of carbon gas at a temperature of about 80~200° C.; the reaction lasts about 3~48 hr. The molar ratio of the polyvalent alcohol and polyvalent basic acid should be within the range of about 1:10~10:1 and selected according to acid value and the like. In general, the OH value increases as the amount of polyvalent alcohol increases, and the acid value increases as the amount of polyvalent basic acid increases. When the reaction ends, the pressure is reduced to about 100~200 mmHg, and the reaction is continued until the acid value is less than 50. When a predetermined acid value, viscosity, and molecular weight are attained, the temperature is reduced to about 100° C., and a polymerization inhibitor is added. Hydrokenone, p-t-butyl catechol and the like may be used as polymerization inhibitors, and may be added at 0.0001~0.1 wt % relative to raw monomer material.

An esterification catalyst may be used to accelerate the reaction. Examples of useful esterification catalysts include organic metal compounds such as tetrabutylzirconate, zirconium naphthenate, tetrabutyltitanate, tetraoctyltitanate, 3/1 tin oxalate/sodium acetate and the like, and a colorless ester is desirable as a raw material. Catalysts such as alkylphosphate and the like may be used as a color regulator.

The carrier fluid used has a resistance value ($10^{11}$~$10^{16}$ Ω·cm) sufficient to not disrupt the electrostatic latent image. The carrier may be in a liquid state during developing. It is desirable that the boiling point of the carrier is such as to allow easy drying after fixing. It is further desirable that the carrier be odorless and nontoxic, and the solvent has a relatively high flash point.

Examples of useful materials include aliphatic hydrocarbons, alicyclic hydrocarbons, aromatic hydrocarbons, halogenated hydrocarbons, polysiloxane and the like. Normal paraffin solvents and isoparaffin solvents are particularly desirable from the perspectives of odor, toxicity, and cost. Specific examples of such paraffin solvents include Isopar G, Isopar H, Isopar L, Isopar K (Esso. Inc.), and Shelsol 71 (Shell Oil Co.) IP Solvent 1620, IP Solvent 2028 (Idemitsu Sekiyu Kagaku K. K.) and the like. At room temperature, solid wax or paraffin may be used. When using solid wax or paraffin at room temperature, the liquid developer may be heated to a liquid state before use.

The aforesaid charge controller should be actually soluble or solvatable in the carrier fluid, and is used to regulate and stabilize the charge and polarity of the toner in the carrier fluid.

Well-known materials may be used as charge controllers added to the toner and carrier. Examples of useful charge controllers include but are not limited to charge controllers for charging toner to a positive polarity such as aliphatic metal salts such as naphthenic acid, octenic acid, oleic acid, stearic acid, metal salts of organic acids such as metal salts of sulfosuccinic acid ester, metal salts of alkylsulfonic acid and the like, metal salts of phosphate ester, metal salts of abietic acid and abietic acid with added hydrogen and the like, metal salts of aromatic carboxylic acid and sulfonic acid, alkylbenzene calcium sulfonate, phosphate radical surface active agent, organic acid ester of polyvalent alcohol attracted to toner particles (e.g., alkyd resin), and sulfonic acid resin and the like having a high molecular solubility.

Example of useful charge controller for charging toner particles to a negative polarity include surface active agents such as lecithin and the like, materials having high molecular solubility such as polyamide resin attracted to toner particles, and nitrogen containing compounds represented by types (A)~(F) below; these materials may be incorporated as structural components or the polymers or copolymers.

(A) (meth)acrylates having aliphatic amino radicals such as N,N-dimethylaminoethyl(meth)acrylate, N,N-diethylaminoethyl(meth)acrylate, N,N-dibutylaminoethyl (meth)acrylate, N,N-hydroxyethylaminoethyl(meth) acrylate, N-benzyl,N-ethylaminoethyl(meth)acrylate, N,N-dibenzylaminoethyl (meth)acrylate, N-octyl,N,N-dihexylaminoethyl(meth)acrylate and the like;

(B) nitrogen containing heterocyclic vinyl monomers such as N-vinylimidazole, N-vinylindazole, N-vinyltetrazole, 2-vinylpyridine, 4-vinylpyridine, 2-vinylquinoline, 4-vinylquinoline, 2-vinylpyrazine, 2-vinyloxazole, 2-vinylbenzooxazole and the like;

(C) N-vinyl substituted ring-like amide monomers such as N-vinylpyrrolidone, N-vinylpiperidone, N-vinyloxazolidone and the like;

(D) (meth)acrylamides such as N-methylacrylamide, N-octylacrylamide, N-phenylmethacrylamide, N-cyclohexylacrylamide, N-phenylethylacrylamide, N-p-methoxy-phenylacrylamide, acrylamide, N,N-dimethylacrylamide, N,N-dibutylacrylamide, N-methyl,N-phenylacrylamide, piperidine acrylate, morpholine acrylate and the like;

(E) aromatic substituted ethylene monomers containing nitrogen radicals such as dimethlaminostyrene, diethylaminostyrene, diethylaminomethylstyrene, dioctylaminostyrene and the like;

(F) nitrogen-containing vinylether monomers such as vinyl-N-ethyl-N-phenylaminoethylether, vinyl-N-butyl-N-phenylaminoethylether, triethanolamine divinylether, vinyldiphenylaminoethylether, vinypyrrolizylaminoether, vinyl-β-morpholinoethylether, N-vinylhydroxyethylbenzamide, m-aminophenylvinylether and the like.

It is desirable that the polymers containing nitrogen compounds represented by (A)~(F) above are readily soluble in the carrier fluid via polymerization with compounds such as hexyl(meth)acrylate, cyclohexyl(meth) acrylate, 2-ethylhexyl(meth)acrylate, octyl(meth)acrylate, nonyl(meth)acrylate, decyl(meth)acrylate, dodecyl(meth) acrylate, Lauryl(meth)acrylate, stearyl(meth)acrylate, benzyl(meth)acrylate, phenyl(meth)acrylate, vinyllaurate, vinylstearate, styrene, vinyltoluene and the like.

The aforesaid polymers and copolymers containing nitrogen compounds are not limited in functionality to charge controllers, and are particularly desirable as dispersion stabilizers to maintain toner dispersion stability.

Among these nitrogen containing compounds, random or grafted copolymers of methacrylate esters having an alkyl group of 10~20 carbon atoms and N-vinylpyrrolidone or dimethylaminoethylmethacrylate are particularly desirable. The nitrogen containing monomer component in the copolymer is desirably 0.1~30 wt %, and more desirably 0.5~20 wt %.

These charge controllers may be used individually or in combinations of two or more. Although the amount of charge controller will differ by type, an added amount of about 0.0001~10 wt % relative to the carrier fluid is desirable. The amount of added charge controller is more desirably about 0.01~5 wt %, and even more desirably about 0.1~3 wt %. The amount of added charge controller relative to toner is desirably about 1~5 wt %, and more desirably about 5~30 wt %.

Similar amounts of metal oxide compounds such as $SiO_2$, $Al_2,O_3$, $TiO_2$, ZnO and the like also may be added as charge enhancers.

Various types of surface active agents, and various types of soluble macromolecules (macromolecules actually solvatable in the carrier fluid) may be added as dispersion enhancers (dispersion stabilizers) to stabilize the toner dispersion in the carrier fluid. Examples of soluble macromolecules other than polymers and copolymers containing nitrogen compounds include but are not limited to petroleum polyolefin resins, linseed oil, polyalkylmethacrylate and the like. Small amounts of copolymers of monomers having a polar group such as methacrylate, acrylate, alkylaminoethylmethacrylate and the like and the aforesaid soluble macromolecules may be used to increase the affinity with the toner particles. Furthermore, rosin, and rosin substituted resins also may be used.

When the amount of added dispersion agent is too low, the dispersion effectiveness is small and toner particles flocculate, whereas when an excessive amount is added, the liquid developer viscosity becomes excessive so as to make it difficult for the toner particles to move in the carrier fluid, thereby reducing developing speed. Although the amount of added dispersion agent will differ depending on the type, molecular weight, polarity and the like, an amount of about 0.01~20 wt % relative to the carrier is desirable, and an amount of about 0.1~10 wt % is more desirable. If the liquid developer is restored to an adequate state f dispersion via thorough mixing during use, not practical problem will arise even if toner particles have flocculated after the developer has been allowed to stand for a long period. The addition of stabilizer is unnecessary when sufficient toner dispersion is achieved by adding charge controller alone.

Although the present invention is described by way of specific examples hereinafter, it is to be understood that the present invention is not limited to these examples. In the following examples, unless otherwise specified, "parts" refers to "parts-by-weight," Mw refers to weight-average molecular weight, and Tg refers to glass transition temperature.

Production of Liquid Developer

Liquid Developer 1 (Cyan)

A mixture of 100 parts noncrystalline polyester resin (Mw: 4900; Tg: 38.8° C.) and 10 parts cyan pigment CI Pigment No. B-15-3, KET Blue 104 (Dainippon Ink) were mixed, then kneaded for about 4 hr at 180° C. using a twin-shaft kneading device, cooled, and coarsely pulverized using a cutter mill, then finely pulverized using a jet mill (Japan Pneumatic, Ltd.) to obtain cyan toner having a mean particle size of about 10 μm. A mixture of 30 g of the obtained toner particles and 100 g IP Solvent 1620 (Idemitsu Sekiyu Kagaku, K. K.) were mixed, then 1 g laurylmethacrylate/methacrylate copolymer (composition ratio: 95:5; Mw: 170,000) was added as a dispersion agent, and the material was subjected to wet type pulverization for 10 hr using a sand grinder mill set at 2,000 rpm with 1 mm diameter glass beads used as media to obtain a concentrated liquid developer containing a dispersion of cyan toner particles having a volume-average particle size of 2.8 μm.

Then, 100 parts of the obtained concentrated liquid developer was diluted with 900 parts IP Solvent 1620, and 3 parts laurylmethacrylate/N-vinyl-2-pyrrolidone copolymer (composition ratio: 95:5; Mw: 200,000; hereinafter referred to as "LMA/VP") were added as a charge controller to adjust the zeta potential, and the materials were mixed and dispersed for about 20 min using an ultrasonic dispersion device to obtain cyan liquid developer 1.

Liquid Developer 2 (Magenta)

Magenta liquid developer 2 was produced in the same manner as liquid developer 1 with the exception that Magenta pigment CI Pigment No. R-57-1, KET Red 306 (Dainippon Ink, Ltd.) was substituted for the aforesaid cyan pigment, and the amount of LMA/VP charge controller added to adjust the zeta potential was changed from 3 parts to 5 parts.

Liquid Developer 3 (Magenta)

Magenta liquid developer 3 was produced in the same manner as liquid developer 1 with the exception that Magenta pigment CI Pigment No. R-57-1, KET Red 306 (Dainippon Ink, Ltd.) was substituted for the aforesaid cyan pigment, and 3 parts laurylmethacrylate/morpholineethylmethacrylate copolymer (composition ratio: 95:5; Mw: 26,000; hereinafter referred to as "LMA/MEM") was substituted for LMA/VP charge controller added to adjust the zeta potential.

Liquid Developer 4 (Magenta)

Magenta liquid developer 4 was produced in the same manner as liquid developer 1 with the exception that Magenta pigment CI Pigment No. R-57-1, KET Red 306 (Dainippon Ink, Ltd.) was substituted for the aforesaid cyan pigment.

Liquid Developer 5 (Yellow)

Yellow liquid developer 5 was produced in the same manner as liquid developer 1 with the exception that Yellow Pigment CI Pigment No. Y-17, KET Yellow 403 (Dainippon Ink, Ltd.) was substituted for the aforesaid cyan pigment, and the amount of LMA/VP charge controller added to adjust the zeta potential was changed from 3 parts to 8 parts.

Liquid Developer 6 (Black)

Black liquid developer 6 was produced in the same manner as liquid developer 1 with the exception that carbon black Mogul-L (Cabot) was substituted for the aforesaid cyan pigment, and the amount of LMA/VP charge controller added to adjust the zeta potential was changed from 3 parts to 10 parts.

Liquid Developer 7 (Black)

Black liquid developer 7 was produced in the same manner as liquid developer 1 with the exception that carbon black Mogul-L (Cabot) was substituted for the aforesaid cyan pigment, and the wet type pulverization process was shortened from 10 hr to 6 hr using a sand grinder mill to obtain a concentrated liquid developer containing a dispersion of black toner particles having a volume-average particle size of 3.6 $\mu$m.

Table 1 shows the data pertaining to the aforesaid liquid developers 1~7, including pigment type, amount and type of charge controller added to adjust the zeta potential, volume-average particle size of the toner particles, zeta potential, and amount of charge per unit weight (Q/M) of toner particles.

The zeta potential was determined by diluting each of the aforesaid liquid developers 500× using IP Solvent 1620, then electrophoresing toner particles via the application of a voltage and observing the toner particles via laser irradiation using a zeta potentiometer model Lazer Zee Meter Model 501 (PEN. KEM, Inc.), and calculating the zeta potential from the measured particle speed. The value Q/M was calculated by applying a voltage of 300 V to the injected liquid developer for 1 min using a liquid electrode model LE-21 (Kawakita Denkyo, K. K.), and calculating Q/M from the amount of dry toner adhered to the electrode and the amount of flowing current (i.e., amount of charge) at that time.

TABLE 1

| Liquid Developer | Material | Charge Controller | Volume-average particle size ($\mu$m) | Zeta Potential (mV) | Q/M ($\mu$C/g) |
|---|---|---|---|---|---|
| Ex. 1 | Cyan | LMA/VP 3 parts | 2.8 | 78 | 17.8 |
| Ex. 2 | Magenta | LMA/VP 5 parts | 2.8 | 94 | 23 |
| Ex. 3 | Magenta | LMA/MEM 3 parts | 2.8 | 117 | 9.6 |
| Ex. 4 | Magenta | LMA/VP 3 parts | 2.8 | 78 | 17.3 |
| Ex. 5 | Yellow | LMA/VP 8 parts | 2.8 | 109 | 33.3 |
| Ex. 6 | Black | LMA/VP 10 parts | 2.8 | 124 | 49.2 |
| Ex. 7 | Black | LMA/VP 3 parts | 3.6 | 106 | 14.1 |

The obtained liquid developer of each color cyan, magenta, yellow, and black was loaded in an image forming apparatus having the internal construction briefly shown in FIG. 1, and color image formation tests were conducted.

The image forming apparatus shown in FIG. 1 is provided with four toner image forming units A, B, C, and D, and each unit A~D is provided with a an electrophotographic type photosensitive drum 1*a*~1*d*, respectively, and sequentially disposed around the periphery of each said photosensitive drum 1*a*~1*d* are arranged corotron chargers 2*a*~2*d*, image exposure devices 3*a*~3*d* which emit laser beams, liquid developing devices 4*a*~4*d*, squeeze devices 5*a*~5*d*, intermediate transfer roller 6A passing through each said unit, and cleaning devices 7*a*~7*d*. Developing devices 4*a*~4*d* are provided with developer tanks 40*a*~40*d* storing liquid developer, and developing rollers 41*a*~41*d* disposed opposite photosensitive drums 1*a*~1*d*, respectively, so as to maintain a slight spacing therebetween and with the bottom part of said developing roller being immersed in liquid developer. Developer tanks 40*a*~40*d* respectively store cyan, yellow, magenta, and black liquid developer. Intermediate transfer roller 6A is common to each photosensitive drum 1*a*~1*d*, and sequentially arranged around the periphery of said intermediate transfer roller 6A are photosensitive drums 1*a*~1*d*, preheater 8, thermal transfer roller 6B, and cleaning device 9. Paper feeding device 10 and thermal fixing device 11 are disposed adjacent to intermediate transfer roller 6A and thermal transfer roller 6B. Photosensitive drums 1*a*~1*d* are arranged so as to be freely separable from intermediate transfer roller 6A, so as to allow evaluation of the amount of developer without transfer.

When developing, each photosensitive drum 1*a*~1*d* was rotated in the arrow a direction in the drawing, and the surface of said drums was uniformly charged to a potential of about −600 V via corotron chargers 2*a*~2*d*. Then, the surfaces of the photosensitive drums 1*a*~1*d* were irradiated by laser beams emitted from image exposure devices 3*a*~3*d* based on image information so as to form an electrostatic latent image on the surface of said photosensitive drums 1*a*~1*d*.

The electrostatic latent images formed on the surface of photosensitive drums 1*a*~1*d* were then developed by the liquid developer of various colors, via liquid developing devices 4a~4d. The circumferential speed of the developing rollers 41a~41d was set at 50 cm/sec, and the circumferential speed of the photosensitive drums 1a~1d was set at 20 cm/sec. Developing rollers 41a~41d were rotated in the reverse direction to the rotation direction of the photosensitive drums (i.e., the arrow b direction in the drawings).

Thereafter, the excess developer adhered to the photosensitive drums 1a~1d was removed therefrom by squeeze devices 5a~5d so as to form toning images containing a slight amount of liquid on the surface of photosensitive drums 1a~1d. These toner images were then transported directly to a transfer position opposite the intermediate transfer roller 6A via rotation , and sequentially superimposed one upon another on the surface of intermediate transfer roller 6A via electrostatic transfer (electrophoresis). A voltage of +1,000 V was applied to the intermediate transfer roller 6A. The toner images are transferred from toner image forming units A~D to the intermediate transfer roller 6A in the sequence A, B, C, D; when only two or three colors are used, only units A and B, or units A, B, C are used. A primary transfer voltage is set sufficiently large to accomplish transfer with 100% efficiency when toner is not present on the surface of intermediate transfer roller 6A, i.e., when transferring a first color. Thereafter, liquid developer remaining on the surface of photosensitive drums 1a~1d is removed by cleaning devices 7a~7d to prepare for the next toner image formation.

The multilayer toner image sequentially transferred to and overlaid on the surface of the intermediate transfer roller 6A is transported via rotation in the arrow c direction in the drawing together with intermediate transfer roller 6A, and heated to a semi-molten state by preheater 8, then rotated to a thermal transfer position opposite at which the intermediate transfer roller 6A confronts the transfer roller 6B, and the toner image comes into contact with a sheet fed from paper supply device 10 and 10 is transferred to said sheet via the heat and pressure of transfer. At this time, the thermal transfer roller 6B is heated to about 150° C. Thereafter, the residual toner remaining on the surface of the intermediate transfer roller 6A is removed therefrom by cleaning device 9. The transfer sheet is transported to a pair of heat fixing rollers 11, which fuse the toner image to said sheet via heat and pressure to complete the image of a single sheet, whereupon the transfer sheet is ejected to a discharge tray not shown in the drawing.

Color image formation tests were conducted as described above using the apparatus of FIG. 1, and the overlay transfer characteristics (i.e., transfer efficiency of the liquid developer of each color) were evaluated in each case.

EXAMPLE 1

Developer 1 (cyan), developer 2 (magenta), developer 5 (yellow), and developer 6 (black) were used in sequential development and transfer.

EXAMPLE 2

Developer 1 (cyan) and developer 7 (black) were used in sequential development and transfer.

EXAMPLE 3

Developer 1 (cyan) and developer 3 (magenta) were used in sequential development and transfer.

Comparative Example 1

Developer 1 (cyan) and developer 4 (magenta) were used in sequential development and transfer.

Comparative Example 2

Developer 7 (black) and developer 1 (cyan) were used in sequential development and transfer.

Evaluation of Overlay Transfer Characteristics

First, photosensitive drums 1a, 1b, 1c, and 1d and intermediate transfer roller 6A were maintained in the separated state, and a solid image (beta image) was formed on the surface of the photosensitive drums, and the amount of toner adhered per unit area was measured and designated the pretransfer amount. Then, the photosensitive drums and intermediate transfer roller were brought into contact, and a solid image (beta) image was similarly formed on the surface of the photosensitive drum, then the toner images were transferred onto the intermediate transfer roller, and the amount of residual toner per unit area remaining on the surface of the photosensitive drum after transfer was measured and designated the post-transfer amount.

Transfer efficiency was designated thus: transfer efficiency (%)=(1-(post-transfer amount/pretransfer amount))× 100. The amount of adhered toner was invariably the amount measured in a completely dry state.

Evaluation results are shown in Table 2.

TABLE 2

| | Pre-transfer amount (mg/cm2) | Post-transfer amount (mg/cm2) | Transfer Efficiency (%) | Zeta Potential (mV) | Q/M (μC/g) |
|---|---|---|---|---|---|
| Ex. 1 | | | | | |
| 1st color | 0.52 | 0.00 | 100 | 78 | 17.8 |
| 2nd color | 0.48 | 0.00 | 100.0 | 94 | 23.0 |
| 3rd color | 0.45 | 0.01 | 97.8 | 109 | 33.3 |
| 4th color | 0.41 | 0.02 | 95.1 | 124 | 49.2 |
| Ex. 2 | | | | | |
| 1st color | 0.52 | 0.00 | 100.0 | 78 | 17.8 |
| 2nd color | 0.54 | 0.01 | 98.1 | 106 | 14.1 |
| Ex. 3 | | | | | |
| 1st color | 0.52 | 0.00 | 100.0 | 78 | 17.8 |
| 2nd color | 0.58 | 0.00 | 100.0 | 117 | 9.6 |
| CE. 1 | | | | | |
| 1st color | 0.52 | 0.00 | 100.0 | 78 | 17.8 |
| 2nd color | 0.53 | 0.18 | 66.0 | 78 | 17.3 |
| CE. 2 | | | | | |
| 1st color | 0.54 | 0.00 | 100.0 | 106 | 14.1 |
| 2nd color | 0.52 | 0.34 | 34.6 | 78 | 17.8 |

As can be understood from Table 2, transfer efficiency was either not reduced or only very slightly reduced in examples 1~3 of the present invention, wherein toner image overlay and transfer was accomplished using liquid developer having a higher zeta potential in the post-transfer stage. On the other hand, transfer efficiency was markedly reduced in the post-transfer stage in comparative example 1, which used liquid developers having identical zeta potentials for the first and second colors, and comparative example 2, which used liquid developers having a higher zeta potential for the first color than the second color. A clear correlation was not found between the reduction in transfer efficiency and the toner charge per unit weight (Q/M), such that, in the case of liquid developers avoiding reduction in transfer efficiency accompanying overlay transfers is avoided most suitably by adjusting the zeta potential rather than adjusting the toner charge per unit weight.

The aforesaid examples 1~3 and comparative examples 1 and 2 are shown in Table 2. Effectiveness similar to that the effectiveness when using the apparatus of FIG. 1 was obtained even when using and experimental image forming apparatus of a type which directly transfers and overlays toner images of each color on a transfer sheet.

Figure 2:
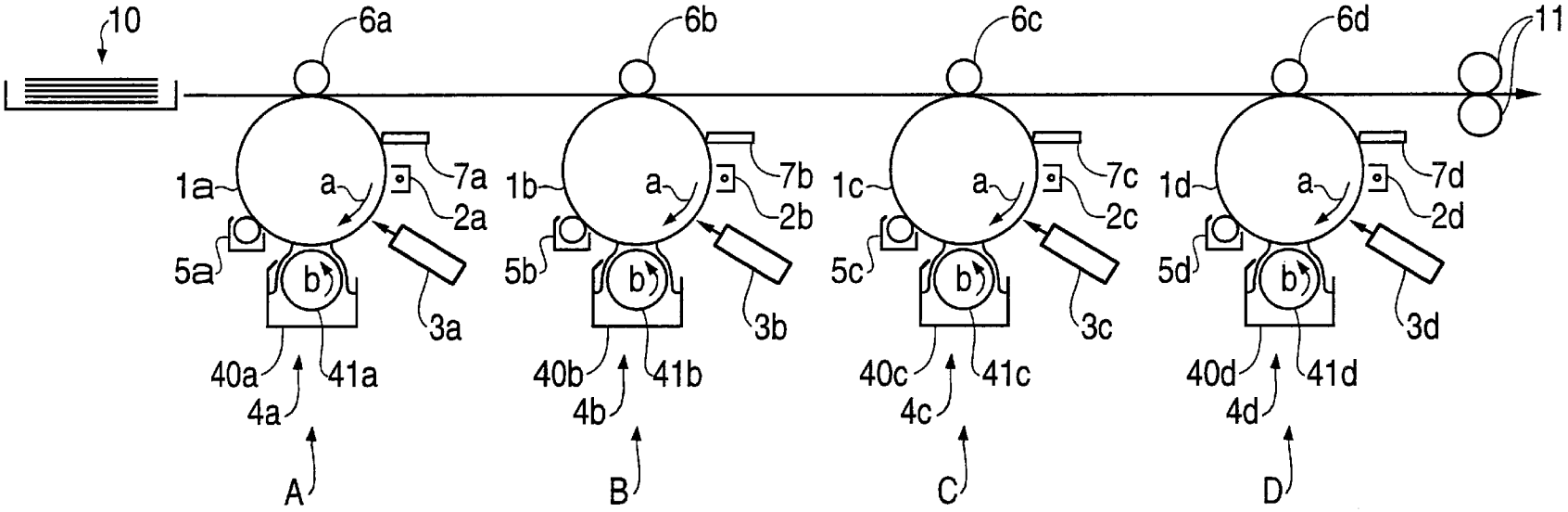
FIG. 2 briefly shows another example of the internal construction of an image forming apparatus.

The image forming apparatus having the construction briefly shown in FIG. 2 is not provided with the intermediate transfer roller 6A, preheater 8, cleaning device 9, and thermal transfer roller 6B of the apparatus of FIG. 1, and is instead substitutes an arrangement of transfer rollers 6*a*, 6*b*, 6*c*, and 6*d* at positions from squeeze devices 5*a*~5*d* to cleaning devices 7*a*~7*d* around the periphery of photosensitive drums 1*a*, 1*b*, 1*c*, 1*d*. These transfer rollers 6*a*~6*d* are formed of semiconductive materials, the surface of which are covered by an electrically insulated rubber layer.

Image formign tests similar to those performed using the apparatus of FIG. 1 were performed using this apparatus; toner images were formed on the surface of photosensitive drums 1*a*~1*d*, and the toner images were directly transported in the arrow a direction in the drawing via rotation to positions opposite the transfer rollers 6*a*~6*d* so as to be brought into contact with a recording sheet fed from paper supply device 10, and said toner images were then sequentially transferred and overlaid one upon another on the surface of said recording sheet via electrostatic transfer (i.e., electrophoresis). A voltage of +1,000 V was applied to the transfer rollers. The toner images are transferred from toner image forming units A~D to the intermediate transfer roller 6A in the sequence A, B, C, D. The recording sheet bearing the overlaid toner images is transported to the pair of thermal fixing rollers 11, which fuses the image thereon via heat and pressure to complete the image of a single sheet, and said recording sheet is then ejected to a discharge tray not shown in the drawing. In other respects of operation and condition, image formation is accomplished in the same manner as by the apparatus of FIG. 1.

The present invention provides a color image forming method using a plurality of liquid developing devices accommodating liquid developers to form toner images and sequentially overlay said toner images on a transfer medium to produce a multilayer toner image, wherein the absolute values of the zeta potential of liquid developers accommodated in developing devices are set sequentially higher from a liquid developing device used to produce a first toner image transferred to a transfer medium to a liquid developing device used to produce a final toner image transferred to said transfer medium.

The transfer medium in the present invention is an intermediate a transfer member, and the formed multilayer toner image also may be ultimately transferred to and fixed on a recording member. The liquid developer also may be a dispersion of colored microparticles in an electrically insulated fluid medium. These colored microparticles may be of different colors. The multilayer toner image also may be a color image. The zeta potential may be adjusted by a charge controller in said liquid developer. The zeta potential also may be adjusted by changing the type of charge controller. The zeta potential also may be adjusted by changing the amount of added charge controller. The zeta potential also may be adjusted by changing the characteristics of the toner. The zeta potential also may be changed by the amount of charge per unit weight of toner particles. The zeta potential also may be adjusted by changing the type of toner binder resin. A characteristic of the toner particles that changes the zeta potential includes particle configuration. The configuration of the toner particles that changes the zeta potential includes the surface area. The configuration of the toner particles that changes the zeta potential includes the particle size. The zeta potential also may be adjusted by changing the type of carrier fluid. The zeta potential also may be adjusted by changing the relative permittivity of the carrier fluid.

The present invention further provides a color image forming apparatus of the electrophotographic type using a plurality of liquid developing devices accommodating liquid developers comprising colored particles (toner) dispersed in an electrically insulated fluid medium (carrier) to form toner images of different colors and sequentially overlay said toner images on a transfer medium via electrostatic transfer to produce a multilayer toner image, wherein the absolute values of the zeta potential of liquid developers accommodated in developing devices are set sequentially higher from a liquid developing device used to produce a first toner image transferred to a transfer medium to a liquid developing device used to produce a final toner image transferred to said transfer medium. Electrophoresis may be used in forming the toner image.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. An image forming apparatus comprising;

a plurality of liquid developing devices, each accommodating a liquid developer that comprises colored particles, and a transfer device for sequentially transferring the colored particles of each of the liquid developing devices to a transfer medium, sequentially forming images on the transfer medium, and wherein each liquid developing device sets the absolute value of the zeta potential of its respective liquid developer, such that the absolute values of the zeta potentials are set sequentially increasing from a first of the liquid developing devices to a last of the liquid developing devices to improve efficiency of the toner transfer.

2. An image forming apparatus as claimed in claim 1, wherein said transfer medium comprises an intermediate transfer member.

3. An image forming apparatus as claimed in claim 1, wherein said transfer medium comprises an intermediate transfer member, and said images are ultimately transferred to a recording medium.

4. An image forming apparatus as claimed in claim 1, wherein each of said liquid developers comprises colored microparticles dispersed in an electrically insulating fluid medium.

5. An image forming apparatus as claimed in claim 4, wherein each of said developing devices contains a liquid developer having colored microparticles of a different color.

6. An image forming apparatus as claimed in claim 1, wherein at least one of the liquid developers includes a charge control material for adjustment of said zeta potential.

7. An image forming apparatus as claimed in claim 6, wherein said zeta potential of the at least one liquid developer is adjusted by changing the type of said charge control material.

8. An image forming apparatus as claimed in claim 6, wherein said zeta potential of the at least one liquid developer is adjusted by changing the amount of said charge control material.

9. An image forming apparatus as claimed in claim 1, wherein the zeta potential of at least one of the liquid developers is adjusted by changing characteristics of its respective colored particles.

10. An image forming apparatus as claimed in claim 9, wherein said characteristics comprise charge per unit weight of said colored particles.

11. An image forming apparatus as claimed in claim 1, wherein the zeta potential of at least one of the liquid developers is adjusted by changing configuration of its respective colored particles.

12. An image forming apparatus as claimed in claim 11, wherein said configuration comprises surface area of said colored particles.

13. An image forming apparatus as claimed in claim 11, wherein said configuration comprises size of said colored particles.

14. An electrophotographic color image forming apparatus comprising:

a plurality of liquid developing devices, each accommodating a liquid developer that comprises a colored toner dispersed in an electrically insulating carrier fluid;

wherein said liquid developing devices sequentially form toner images of different colors on a transfer medium via an electrostatic transfer, each of said toner images after a first of the toner images and up to a last of the toner images being superimposed over a previous of the toner images to produce a multilayer toner image; and wherein each liquid developing device sets the absolute value of the zeta potential of its respective liquid developer, such that the absolute values of the zeta potentials are set sequentially increasing from the liquid developing device that transfers the first toner image to the liquid developing device that transfers the last toner image to improve efficiency of the toner transfer.

15. An electrophotographic color image forming apparatus as claimed in claim 14, wherein said zeta potential of at least one of the liquid developers is adjusted by changing a type of toner binder resin contained in said at least one liquid developer.

16. An electrophotographic color image forming apparatus as claimed in claim 14, wherein said zeta potential of at least one of the liquid developers is adjusted by changing the type of its carrier fluid.

17. An electrophotographic color image forming apparatus as claimed in claim 16, wherein said zeta potential of said at least one liquid developer is adjusted by changing the relative permittivity of its carrier fluid.

18. A method for forming an image comprising the steps of;

setting the zeta potential of a first liquid developer to a first value and setting the zeta potential of a second liquid developer to a second value, wherein the absolute value of the second value is set higher than the absolute value of the first value to improve efficiency of toner transfer, forming a first toner image on a transfer medium with the first liquid developer, and forming a second toner image on said transfer medium with the second liquid developer after forming the first toner image.

19. A method for forming an image as claimed in claim 18, wherein said transfer medium comprises an intermediate transfer member.

20. A method for forming an image as claimed in claim 18, further comprising a step of transferring said toner images to a recording medium.

* * * * *